United States Patent [19]

Johnson et al.

[11] 4,134,581

[45] Jan. 16, 1979

[54] VIRTUAL BIN COLLATOR CONTROL

[75] Inventors: Frederick W. Johnson; Carl A. Queener, both of Boulder, Colo.; James C. Rogers, Wyckoff, N.J.

[73] Assignee: International Business Machines Corporation, Armonk, N.Y.

[21] Appl. No.: 752,777

[22] Filed: Dec. 20, 1976

[51] Int. Cl.[2] ..... B65H 39/10

[52] U.S. Cl. ..... 271/173

[58] Field of Search ..... 271/173, 64

[56] References Cited

U.S. PATENT DOCUMENTS

| | | | |
|---|---|---|---|
| 3,283,705 | 11/1966 | Niesen | 271/173 X |
| 3,484,101 | 12/1969 | Cassano | 271/173 |
| 3,561,754 | 2/1971 | Gaffron | 271/173 |
| 3,802,694 | 4/1974 | Post | 271/173 |
| 3,870,295 | 3/1975 | Kukucka | 271/173 |

*Primary Examiner*—Richard A. Schacher
*Attorney, Agent, or Firm*—Carl O. Barth

[57] ABSTRACT

The invention concerns a method of controlling a multi-bin sheet collator. Adjacent collator bins are treated as one virtual bin and sheet feeding is controlled appropriately by skipping bins if the number of sets to be collated equals or is smaller than half the number of bins. Thus, multi-page documents having a number of pages exceeding the capacity of a single bin can be collated. In a combined copier/collator the number of copies selected by the operator determines the number of sets, and thus the size and grouping of the virtual bins.

12 Claims, 13 Drawing Figures

| COPY SELECT | INCREMENT LIMIT | VIRTUAL BIN CONFIGURATION |
|---|---|---|
| 2 | 5 |   |
| 3 | 3 |   |
| 4 OR 5 | 2 |   |

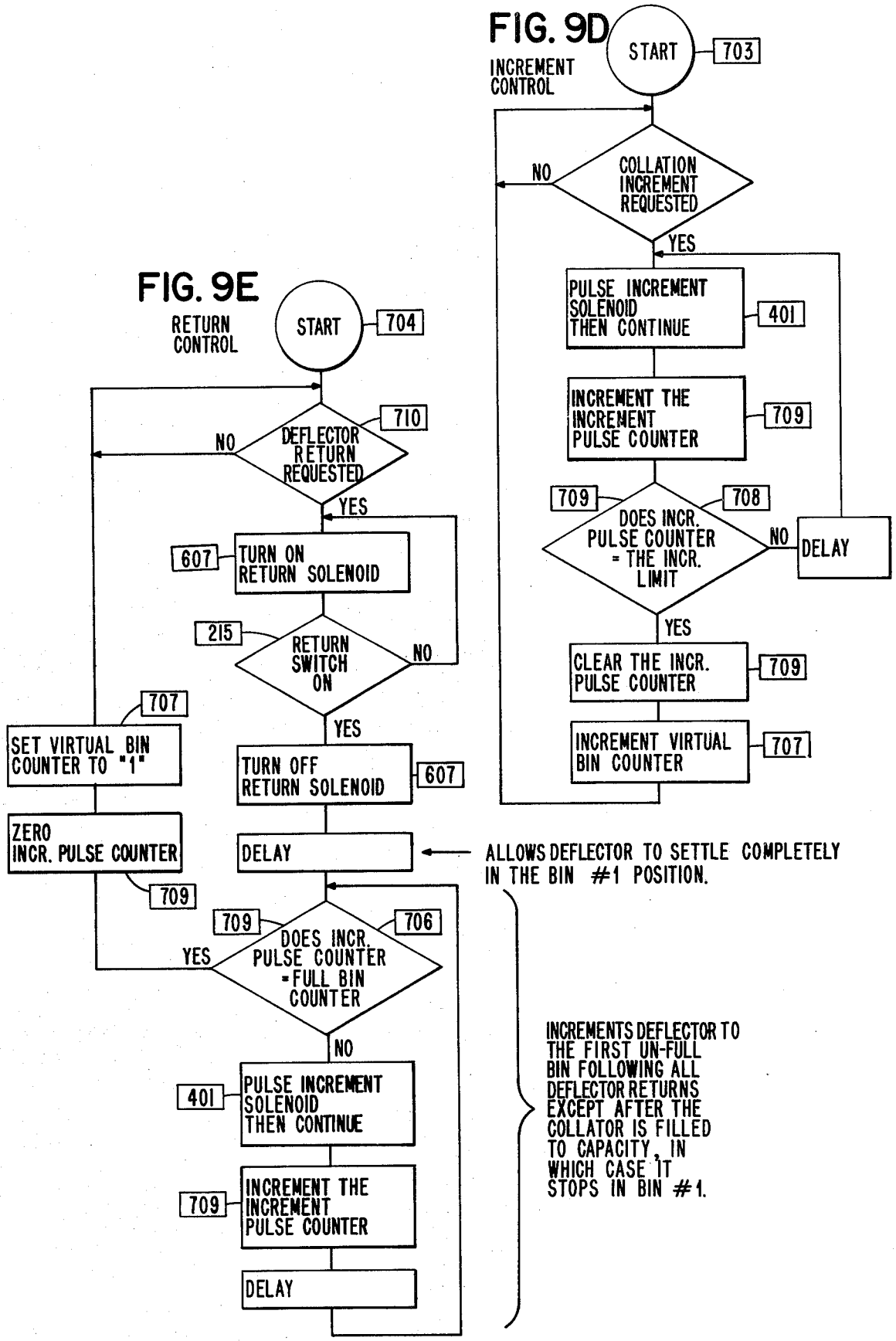
FIG. 9D
INCREMENT CONTROL
START
703
COLLATION INCREMENT REQUESTED
NO
YES
PULSE INCREMENT SOLENOID THEN CONTINUE
401
INCREMENT THE INCREMENT PULSE COUNTER
709
709
708
DOES INCR. PULSE COUNTER = THE INCR. LIMIT
NO
DELAY
YES
CLEAR THE INCR. PULSE COUNTER
709
INCREMENT VIRTUAL BIN COUNTER
707
FIG. 9E
RETURN CONTROL
START
704
710
DEFLECTOR RETURN REQUESTED
NO
YES
607
TURN ON RETURN SOLENOID
215
RETURN SWITCH ON
NO
YES
707
SET VIRTUAL BIN COUNTER TO "1"
TURN OFF RETURN SOLENOID
607
ZERO INCR. PULSE COUNTER
709
DELAY
ALLOWS DEFLECTOR TO SETTLE COMPLETELY IN THE BIN #1 POSITION.
709
706
DOES INCR. PULSE COUNTER = FULL BIN COUNTER
YES
NO
401
PULSE INCREMENT SOLENOID THEN CONTINUE
709
INCREMENT THE INCREMENT PULSE COUNTER
DELAY
INCREMENTS DEFLECTOR TO THE FIRST UN-FULL BIN FOLLOWING ALL DEFLECTOR RETURNS EXCEPT AFTER THE COLLATOR IS FILLED TO CAPACITY, IN WHICH CASE IT STOPS IN BIN #1.

VIRTUAL BIN COLLATOR CONTROL

FIELD AND BACKGROUND OF THE INVENTION

The invention relates to the field of collator apparatus, i.e., sorting devices for sheet material as used to a large extent to produce multiple collated sets of multi-page documents which have been printed or copied.

Various collators or sorting apparatus are known in the art. Copending patent application, filed on Aug. 2, 1976, Ser. No. 710,835, and assigned to the same assignee as the present application, describes a mini-collator attached to a convenience copier, and contains a discussion of the prior art development of such apparatus. The above application, Ser. No. 710,835, is incorporated herein by reference.

The limiting factor in all prior art collators is usually the number of collator bins available, and the sheet holding capacity of each individual bin, or at least the smallest of the bins. The smaller the collator, the more important is this limitation. In the above referenced case of the mini-collator which has a very small number of bins with a limited capacity each, the operational limits, are, of course, reached much earlier than with a large collator with fifty or one hundred bins and a large sheet holding capacity. The theoretical example below shall exemplify the limitations.

In the above-referenced patent application, Ser. No. 710,835, a mini-collator is shown for the exemplary preferred embodiment as comprising ten bins with a capacity of twenty sheets each. Although this collator satisfies a very large number of customer requirements, it obviously reaches a limit as soon as documents with more than twenty original pages have to be copied and collated. When, for example, five copies of a twenty-five page document have to be produced, collation has to be made in two steps. The first step executed by the operator would be to copy the first twenty pages of the original and collate it. Then, the copies are removed from the collator. The second step would include the copying of the remaining five pages of the document, collating it, and attaching it to the already unloaded twenty page sets. On one hand, this merging of two collated half-sets requires the interaction by the operator, on the other hand, it may introduce mistakes by wrongly collating sets.

It is one object of the present invention to improve the capabilities of collators.

Another object of the invention is to enable collation of sets whose number of pages exceeds the bin's sheet holding capacity.

The further object of the invention is to provide the more efficient use of collators with limited capacities.

An additional object is to adapt a collator automatically to the collation job.

Another object is to provide a versatile and adaptive copier/collator combination.

SUMMARY OF THE INVENTION

The invention achieves these and other objects by a special method for controlling the operation of a sheet collator and a collator performing this method.

The following example shall exemplify the concept. The sheet collator is assumed to have K bins, each of which has at least a capacity of L sheets. As soon as the number M of sets to be collated is known, and this number is at least smaller than K but preferably smaller than K/2, said K bins are divided into at least M virtual bins, each virtual bin comprising at least two actual preferably adjacent bins. Each virtual bin is of a sheet capacity equal to L times the number of actual bins in a virtual bin. Thus, if a virtual bin comprises N actual bins, the sheet capacity of the virtual bins is N.L. In addition, if a virtual bin comprises N actual bins, the totality of the K actual bins is proportioned as $K=MN+R$, where R is the remaining number of actual bins not used. After these virtual bins have been established, the filling of the bins is controlled to enable the collation of one complete set in each virtual bin, i.e. in adjacent actual bins if the number of pages of a set exceeds L.

In a copier/collator combination as described in the above-referenced application, Ser. No. 710,835, the input command for the establishment of the virtual bins is given by the operator of the copier when defining the number of copies to be made. Assuming that a ten bin mini-collator is used ($K=10$), each bin having a capacity of twenty sheets ($L=20$), the logic of the copier/collator determines the virtual bin division as soon as the operator has chosen the number of copies to be made and collated. For a selection of three copies ($M=3$) in the collate mode of the machine, three adjacent bins would form a virtual bin, i.e., actual bins #1 to #3 form virtual bin I, actual bins #4 to #6 form virtual bin II, actual bins #7 to #9 form virtual bin II1 and the last actual bin #10 remains unused ($R=1$). Thus, collation of documents up to sixty pages is possible, whereas — in the standard mode of using collators — sixty page documents could not be collated in one job in the described collator.

If, in the same arrangement, the operator selects five copies to be made ($M=5$), the logic of the copier/collator would select always two adjacent actual bins ($N=2$ and $R=0$) to form one virtual bin with a capacity of forty sheets.

Generally speaking, the basic thrust of the invention is a method for controlling the operation of a sheet collator when collating a number M of multi-sheet sets. Assuming the collator has K bins of different sizes and M is smaller than K, then the K bins can be grouped into H virtual bins with H larger or equal to the number M of sets.

If, for example, the collator has two modules, the first module having five bins ($K_1=5$) with twenty sheet capacity each ($L_1=20$), the second collator module having ten bins ($K_2=10$) with ten sheets capacity each ($L_2=10$), a collation job of ten sets ($M=10$) of twenty sheets each cannot be performed by this collator in one run. According to the invention, if the ten bins of the second collator are grouped into five virtual bins by treating every two adjacent actual bins as one virtual bin with a capacity of $10+10=20$ sheets, then the above collation job can be done in one single run. The first five sets will be collated into the actual bins of the first collator module. The second 5 sets will be collated into the five virtual bins of the second collator module:

The first of the ten bins of the second collator module will receive the first ten sheets of one (precisely: the 6th) set, the second bin will receive the remaining ten sheets of the 6th set. Thus, the first, third, fifth, seventh and ninth bin of the second module will finally contain the first ten sheets of the second ten sets, and the second, fourth, sixth, eighth and tenth bin will be filled with the appropriate second ten sheets.

This method can be extended to more than two collator modules as well as to different bin capacities in one single module. The basic condition is that the number M of multi-sheet sets to be collated is smaller than the number K of actual bins in any given arrangement ($M<K$). Then, by grouping preferably adjacent actual bins, virtual bins can be formed which are treated by the collator control as if they were enlarged capacity bins.

The foregoing and other features of the invention, as well as its advantages will be apparent from the following detailed description of a preferred embodiment which is illustrated in the accompanying drawings.

BRIEF DESCRIPTION OF THE DRAWINGS

FIGS. 9A to 9E show flowcharts describing the functions carried out by collator control 118.

DESCRIPTION OF THE PREFERRED EMBODIMENT

Figure 1:
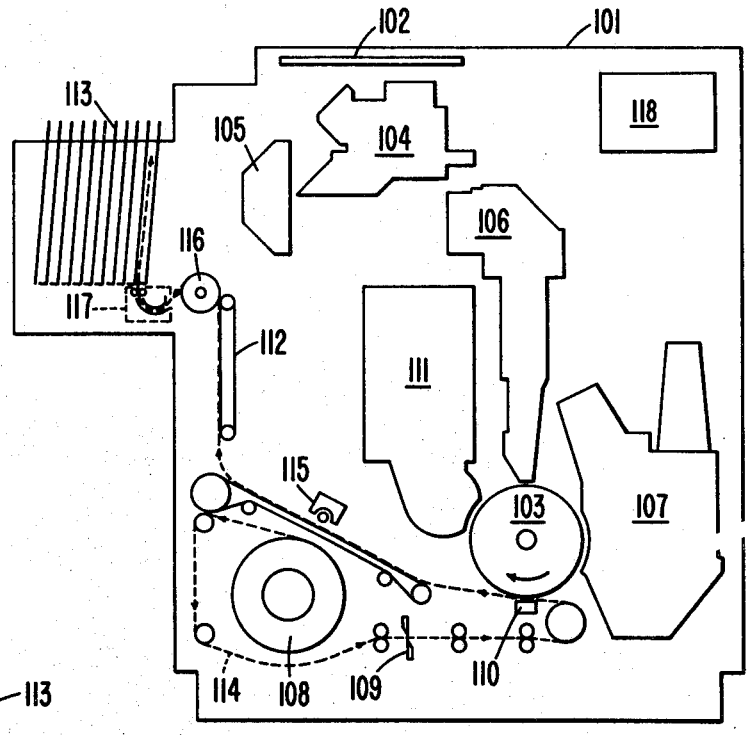
FIG. 1 is a schematic view of a xerographic copier incorporating the present invention.

FIG. 1 shows a schematic view of a xerographic copier 101 incorporating the present invention. A document which is to be copied is placed on the document glass 102 and imaged via the optical system 104, 105, and 106 onto the xerographic drum 103 which has been precharged by a (not shown) precharge unit. The exposition of xerographic drum 103 discharges it partly, so that a latent electrostatic image is formed on the photoconducting drum 103. The image is developed by developing station 107. In the meantime, paper has been fed through paper path 114 from paper roll 108 to cutting knife 109 where it is cut to sheets of the desired length. In a transfer station with the transfer corona 110, the developed or tonered image is transferred to the sheet of paper. After that, the remaining toner is cleaned off the photoconductor drum 103 by cleaning station 111. Additionally, the entire surface of the drum is exposed to light to dissipate the electrostatic charge. The photoconductor is now ready for the following cycle.

In the meantime, the toner transferred to the paper is fused, i.e. heated and melted onto the paper, in fusing station 115. The thus produced copy is now fed via the vacuum transport belt 112 over roll 116 to the movable deflector 117 into one of the bins of collator 113. In the embodiment, collator 113 consists of 10 bins each having a sheet capacity of 20. Other collator arrangements, sizes and bin capacities can be used in a similar way. It is of no difficulty to somebody skilled in the art to apply the invention to other collator arrangements, may they consist of separate copiers or printers and collators or of combined copier/collators. As detailed above, the invention is equally applicable to copiers or printers with more than one collator even if the collators have different sizes.

The copier 101 comprises a collator control 118 which may be a microprocessor serving to control the copier function as well as the collator function. Examples of similar microprocessors can be found in copending U.S. applications Ser. Nos. 729,453 and 729,451, filed Oct. 4, 1976, and assigned to the same assignee as the present application. It shall be pointed out that it is not necessary to use a microprocessor for execution of the invention, although this may be the most economical way. The invention method of controlling a collator can be implemented in electronic hardware as well as in an electromechanical layout.

The function of the collator will be described in detail below.

The above is a very general description of a copier which can be modified in various aspects. For example, the roll paper supply can be replaced by a cut sheet paper supply; the schematically depicted radiant fuser can be substituted by a hot roll fuser and the transport system does not necessarily need to be a vacuum system. These and other changes as well as well additional stations, e.g. a paper detach arrangement to loosen the paper from the xerographic drum 103 or a copy discharge station, are well known and can be used by anybody skilled in the art as necessary.

Figure 2:
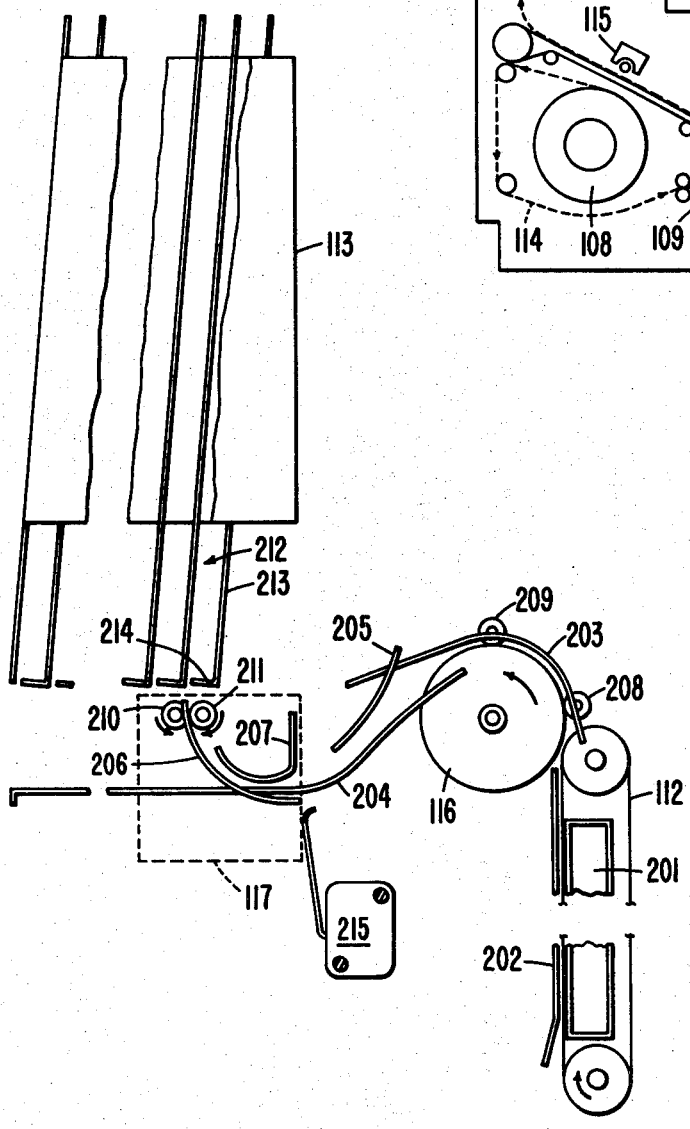
FIG. 2 shows the copy paper path into the collator.

FIG. 2 shows the paper path of the copy after fusing and the collator in more detail. A copy is held onto the transport belt 112 by vacuum which is applied to vacuum chamber 201. The vertical paper baffle 202 serves as an additional guide for the copy which is then fed over roll 116, supported by deflector guide 203 and small rolls 208 and 209.

Roll 116 may be used to accelerate the copy speed. Whereas, for example, the copy speed in the paper path before roll 116 may be approximately 24 centimeter per second (9.3 inches per second), it may be accelerated to 76 centimeter per second (30 inches per second). This acceleration may be necessary for proper stacking of the copies in collator 113. This is due to the fact that the movable deflector 117 needs some time to step from copy bin to copy bin and back from the last bin into its initial position.

The copy, accelerated by roll 116, is now fed onto main guide 204, being held down by the short upper guide 205.

All guides mentioned till now, the vertical baffle 202, the deflector guide 203, the main guide 204 and the upper deflector guide 205 are basically stationary, though they may be pivotable or otherwise removable for the clearance of paper jams.

When the copy, which is moving on main guide 204 reaches the movable deflector unit 117, it is gripped by the lower deflector guide 206 which partially extends through slits in main guide 204 into the nip between the two deflector drive rolls 210 and 211. The copy is held down by upper deflector guide 207. Both guides 206 and 207 as well as the drive rolls 210 and 211 are movable, together with the deflector unit 117. Thus, these parts remove and feed each copy they receive from stationary main guide 204 into the copy bin 212 which is above them.

Each copy bin 212 consists essentially of two slightly inclined walls 213, one of which has on its lower end a lip 214 extending toward the other wall, leaving a small slit open to allow paper feeding into the bin. The copy is fed into the bin 212 with a speed high enough to move its trailing edge a little way into the bin. Because of the bin's inclination, the copy falls down so that its trailing edge rests on lip 214, whereas the copy sets close to the wall 213 having the lip 214. Each bin 212 may include retainer means that improve the resting of the copies against the wall with the lip. Since roller 116 accelerates the copies, the gap between two successive copies is increased to allow the collator's movable deflector unit 117 to step from bin to bin and to be transported back from the last bin (the left bin in FIG. 2) to its shown position under the first bin.

Return switch 215 is arranged such that it detects when the deflector unit 117 is positioned under the first bin 212. Thus, it serves as return switch, indicating the home or initial position of deflector unit 117. The output signal produced by return switch 215 forms one input to the collator control 118, as will be described later in detail.

Figure 3:
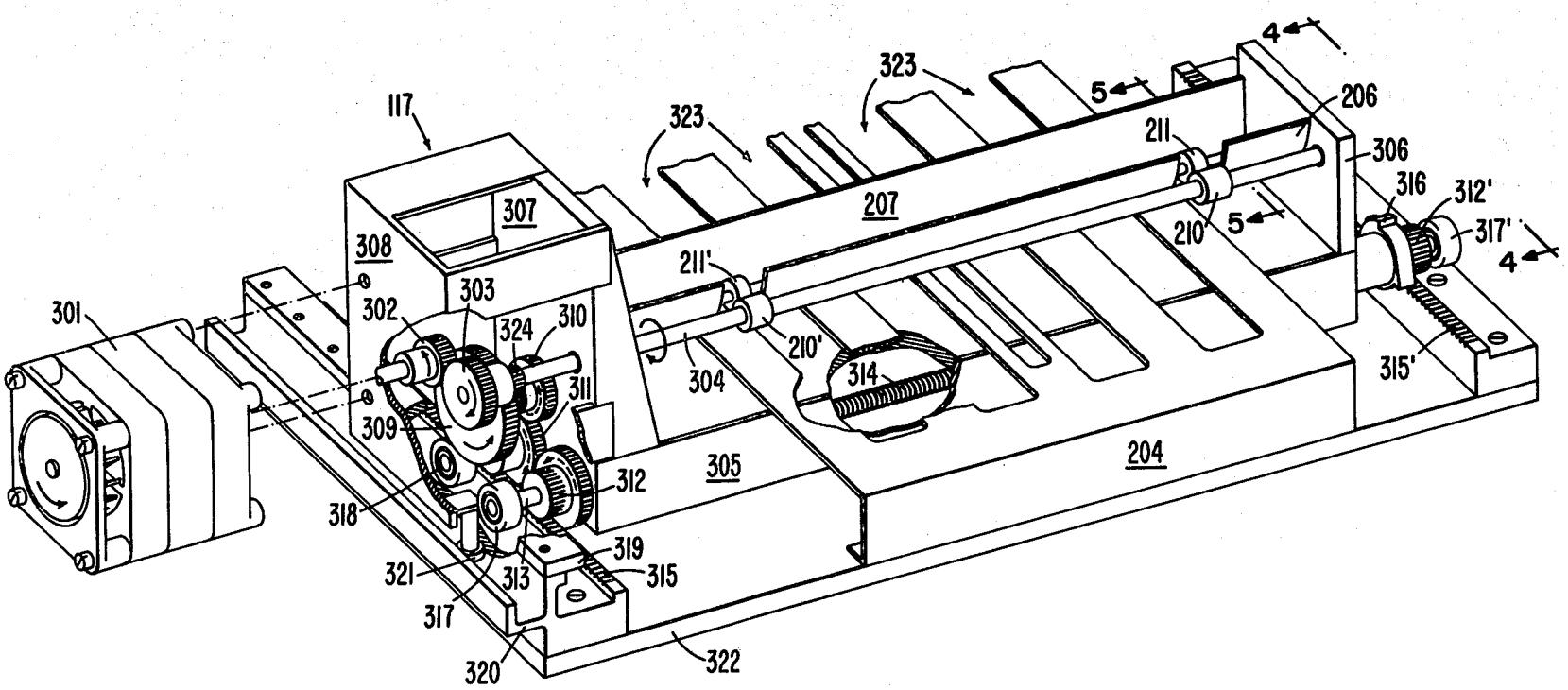
FIG. 3 is a detailed isometric view of the deflector unit of the collator and its guiding system.

FIG. 3 shows in some more detail the deflector unit 117 with its drive and guiding system. The deflector unit 117 which has already been shown in FIGS. 1 and 2 consists of a deflector frame 305 with two flanges 306 and 307 extending perpendicularly at the frame's 305 ends. Flange 307 bears a gear box 308 to which a drive motor 301 is fixed.

The gearbox 308 contains a gear system which drives the paper feed system of the deflector unit 117 as well as it moves it. The paper feed drive consists of the motor gear 302 which is fixed to the motor's 301 drive shaft, and the drive roll gear 303 fixed to the drive roll shaft 304 which is rotatably mounted in flanges 306 and 307. Drive roll shaft 304 bears driven rolls 210 and 210'. The paper is fed between this pair of drive rolls and an associated pair of backup rolls 211 and 211'. The copy to be fed is directed by the lower deflector guide 206 and the upper deflector guide 207 which have already been shown in FIG. 2.

A small gear 324 on drive roll shaft 304 drives a larger gear 309 constantly. This constantly driven arrangement of gears is defined by solid arrows on the respective gears in the drawings. Gear 310 being coaxial with gear 309 is driven by the latter over a switchable clutch which is shown in detail in FIG. 6. Gear 310 drives deflector drive pinion gear 312 over an intermediate gear 311. The direction of drive of these latter three gears is shown by broken arrows.

When the clutch between large gear 309 and gear 310 is engaged, deflector drive pinion gears 312 and 312', the latter being fixed to the opposite end of deflector drive shaft 313 meshing with gear racks 315 and 315' respectively, drive deflector unit 117 which is guided by guide rolls 317, 317', and 318. Together with guide rail 319, rolls 317 and 318 and a similar arrangement on the other side of the deflecting unit guarantee the vertical guidance of the deflector unit. Lateral or horizontal guidance is accomplished by a horizontal guide roll 321 engaging a horizontal U-shaped guide rail 320.

Deflector drive spring 314 is fixed with one end to deflector frame 305 and with its other end to deflector drive shaft 313. Thus, when the deflector drive unit 117 is moved to its initial leftmost position, the deflector drive spring is wound up. As soon as the deflector drive unit 117 reaches this position, the clutch which connects large gear 309 with gear 310 is disengaged. Therefore, the rotation of gears 310, 311 and 312 is stopped as well as the movement of the deflector unit 117.

From now on, deflector unit 117 is moved by force of the biased deflector drive spring 304. Stepping from bin to bin (compare FIG. 2) is controlled by a ratchet disk 316 fixed to deflector drive shaft 313. The details of the ratchet mechanism are shown in FIG. 4 and described below.

Attached to the collator frame 322 is the main paper guide 204 for the copies as already shown in FIG. 2. This main guide 204 has longitudinal slits 323 into which fingers of lower deflector guide 206 extend.

It should be added that the produced copies are fed into the collator shown in FIG. 3 from the left upper corner and that the initial position of deflector unit 117, i.e., the position under the first bin, is in the leftmost upper end of the collator frame 322.

Figure 4:
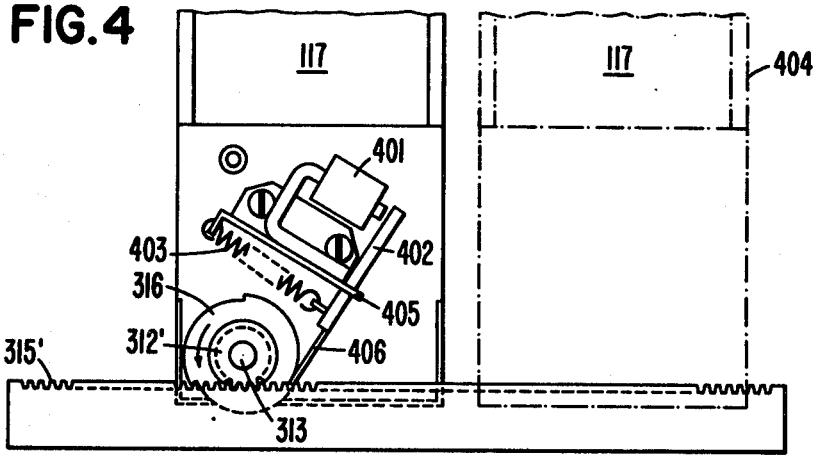
FIG. 4 shows a side view of the deflector unit in different positions as seen from direction 4—4 in FIG. 3.

FIG. 4 depicts a side view of the deflector unit 117 in two different positions from direction 4—4 in FIG. 3. It shows in detail the ratchet mechanism which controls the stepwise moving or incrementing of the deflector unit from bin to bin. Deflector unit 117 is shown in its initial position by the broken dotted line 404 on the right side of the drawing. The solid line picture of deflector unit 117 defines any intermediate position under one of the bins. As already described in connection with FIG. 3, deflector drive pinion gear 312' meshes with gear rack 315'. The pinion gear 312' is fixed to the deflector drive shaft 313, as is the ratchet disk 316.

Ratchet disk 316 is blocked or released by a pawl which is actuated by a solenoid ratchet device. This consists essentially of increment solenoid 401 activating an armature 402, which is pivotable around a dolly of frame 405 of the ratchet device and held by a tension spring 403 against ratchet disk 316. Upon activation of increment solenoid 401 by the collator control 118, armature 402 is attracted disengaging pawl 406 from ratchet disk 316. Thus, ratchet disk 316 is able to rotate until it is brought to a stop by pawl 406 on armature 402 which, in the meantime, has been deactivated. Ratchet disk 316 is always forced against pawl 406 by tension of the deflector drive spring wound around deflector drive shaft 313. This arrangement was shown in detail in FIG. 3.

The number of ratchet teeth as well as the circumference of ratchet disk 316 and the radius of deflector drive pinion gear 312', both being fixed to deflector drive shaft 313, are chosen to let the deflector unit 117 step from one bin to the next one.

Figure 5:
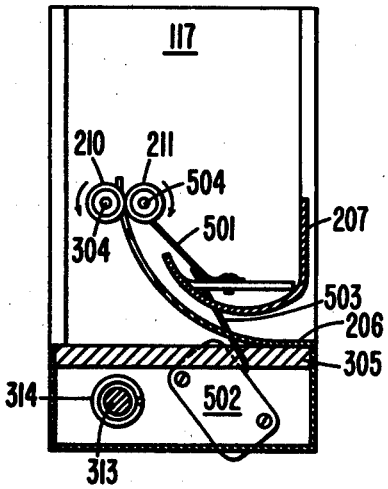
FIG. 5 is a cross-section of the deflector unit along line 5—5 in FIG. 3.

FIG. 5 shows a crossection along the line 5—5 depicted in FIG. 3. It shows the deflector unit's 117 upper deflector guide 207 and the lower deflector guide 206 defining the copy path. Copies are driven through that path by drive roll 210 fixed to drive roll shaft 304 turning permanently in the direction shown by the arrow. The copy is held against drive roll 210 by backup roll 211 mounted to backup roll shaft 504. This shaft is mounted to an extension of the upper deflector guide 207 by a leaf spring 501, pressing the backup roll 211 against drive roll 210. Included in the deflector frame 305 is the deflector drive shaft 313 with the deflector drive spring 314 wound around it. Additionally, microswitch 502 is provided, the actuating arm 503 of which extends through one of the slits in the lower deflector guide 206 (see FIG. 3) into the copy path. This switch is used as input device for the collator control 118. Thus, a copy passing the deflector unit 117 delivers a pulse to collator control 118 which may be counted as will be described below.

Figure 6:
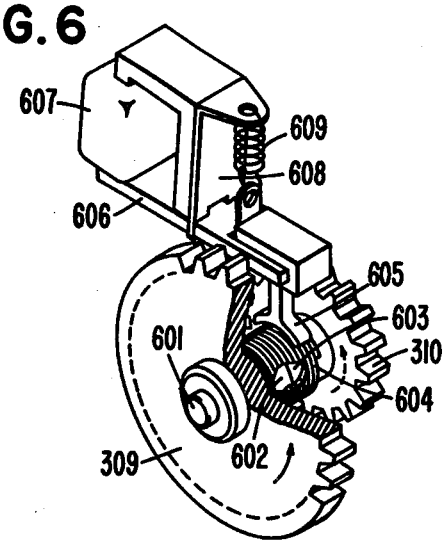
FIG. 6 depicts a detail of the deflector drive.

FIG. 6 shows a detail of the deflector drive which was already mentioned in the description of FIG. 3. Gear 309 is permanently driven by the deflector drive motor (301 in FIG. 3). Together with its hub 602, it is rotatably mounted on axle 601. Rotation occurs in anticlockwise direction, as depicted by the solid arrow. On the other end of the same axle 601, small gear 310 with its hub 603 is rotatably mounted. Around the hub 602 of the large gear 309, a clutch spring 604 is wound and fixed, at least with its end, thereto. The inner diameter of clutch spring 604 is slightly larger than the outer diameter of hub 603 of the small gear 310. Thus, the assembly made out of large gear 309, its hub 602 and clutch spring 604 can rotate without effecting small gear 310. T-shaped clutch actuator 605 is held in a short distance above the clutch spring 604 over the hub 603 of small gear 310. This is effected by tension spring 609 holding armature 606, which is pivotable around a dolly of frame 608, in its deactivated position. As soon as return solenoid 607 is actuated, armature 606 is attracted and clutch actuator 605 pressed down onto the rotating clutch spring 604. This braking force being applied upon the outer diameter of the spring leads to a contraction of clutch spring 604, coupling the hub 603 of the small gear 310 with the spring. Thus, large gear 309 and small gear 310 are coupled to each other along small gear 310 turning in the direction defined by the broken arrow. Upon deactivation of return solenoid 607, clutch actuator 605 is released from clutch spring 604, whereupon small gear 310 is disengaged from large gear 309. As described in connection with FIG. 3, engagement of the clutch and driving of small gear 310 serves to move the deflector unit 117 back into its initial position and simultaneously winds deflector drive spring which afterwards serves as energy source for the deflector unit's stepping. As soon as deflector unit 117 reaches its home position under the first bin 212 of the collator 113, return switch 215 (FIG. 2) is actuated.

Figure 7:
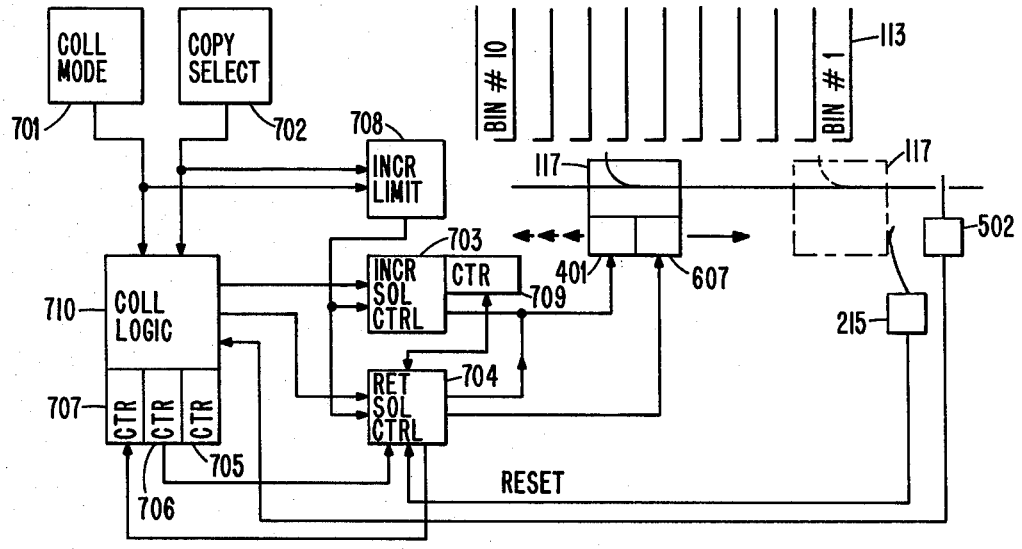
FIG. 7 shows a schematic layout of the collator control 118 in FIG. 1.

FIG. 7 shows in some more detail the collator control circuitry which was designated 118 in FIG. 1. Collator 113 is depicted schematically in FIG. 7 and, consists of ten bins with a capacity of twenty sheets per bin. Deflector unit 117 is moveable under the entrance slits of the bins and stacks the transported sheets into the bins. In each bin, succeeding sheets are always stacked to the left of sheets already contained in the bin.

Return switch 215 was shown already in FIG. 2 and is arranged to be actuated by the deflector unit 117 when in its home position under the first, i.e., rightmost bin of the collator 113. Deflector unit 117 contains increment solenoid 401 which, upon each pulse applied to it, transports deflector unit 117 to the next bin left of the preceeding bin. In the shown embodiment, a pulse of fifty milliseconds applied to the solenoid 401 effects this step by step movement. The details of the increment solenoid and its arrangement were shown in FIG. 4. Contained in the moveable deflector unit 117 also is return solenoid 607 which, when actuated, moves deflector unit 117 into its home position under the first, i.e. right-most bin. Details of the return actuating mechanism were shown in FIG. 6.

Sheet switch 502 is arranged in the paper path through which the copies travel. Although it was shown in FIG. 5 arranged in the moveable deflector unit 117, it can as well be arranged anywhere in the paper path as schematically shown in FIG. 7. The switch 502 has to be positioned such that all sheets in the paper path passing it cause it to be on as long as any part of the sheet is touching its actuator 503, as depicted in FIG. 5.

Collator logic 710 performs several functions. It counts the sheets entering the collator by the use of the pulses from sheet switch 502. Furthermore, it requests collator carriage incrementation via increment solenoid control circuit 703 by actuating the increment solenoid 401. Additionally, it serves to return the deflector unit 117 by actuating the return solenoid via return solenoid control 704. Finally, collator logic 710 determines when the collator has been filled to its capacity and stops the copier and/or collator. All of these functions are described below and in the flow charts in detail.

The operator of the copier/collator combination selects the collate mode over the mode selector 710. Additionally, he chooses with the copy selector 702 the number of copies he wants to produce. The collate mode selector 701 causes the collator logic 710 to perform a "collate" function as opposed to a non-collating "stack" or "exit pocket" function as described in the above referenced patent application Ser. No. 710,835. The two non-collating functions referred to do not relate to the present invention and are therefore not further addressed. The copy selector 702 is a means with which the operator indicates the number of copies desired of each original to be produced.

Increment solenoid control circuit 703 causes the deflector unit 117 to skip to the next bin via increment solenoid 401. The number of incrementing steps is determined by the increment limit circuit 708. Inputs to the increment limit 708 circuit are derived from collate mode selector 701 and copy selector 702. FIG. 9B is a flow diagram showing the setting of the increment limit circuit 708 by these inputting devices.

Return solenoid control circuit 704 causes the deflector unit 117 to return under the first bin (Bin #1) into its home position. Additionally, it may serve to increment deflector unit 117 to the first non-full bin, except if the collator has been filled to capacity. These interrelationships are shown in the functional flow chart of FIG. 9E.

Associated with collator logic 710 are several counters. Sheet counter 705 counts the number of sheets delivered to each of the non-full bins. Full bin counter 706 indicates the number of full actual bins within each virtual bin. Virtual bin counter 707 indicates the virtual bin number corresponding to the present position of deflector unit 117. The function of sheet counter 705 is shown in detail in FIG. 9C. Full bin counter 706 is functionally depicted in FIGS. 9C and 9E, and virtual bin counter 707 is functionally explained in FIGS. 9C, D and E.

Increment limit circuit 708 was already mentioned above. This circuit determines the number of actual bins to be skipped when deflector unit 117 moves from one virtual bin to the next. In other words, increment limit 708 determines the size of the virtual bins, i.e. the number of actual bins contained in each virtual bin.

Associated with already mentioned increment solenoid control circuit 703 is increment pulse counter 709 which counts the number of actual bins skipped during deflector unit incrementation and return. The function of increment pulse counter 709 can be seen from FIGS. 9D and 9E.

Figure 8:
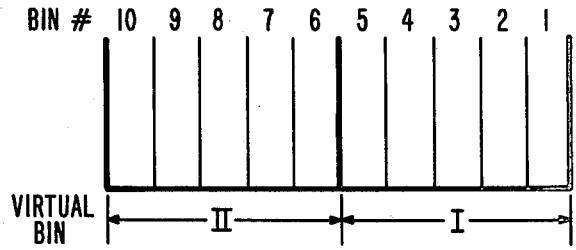
FIG. 8 is a table showing the relationship between copy selection and bin configuration in the described embodiment.
Figure 8:
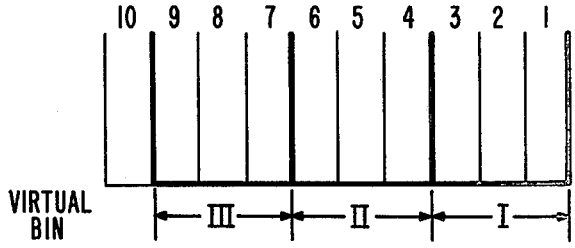
Figure 8:
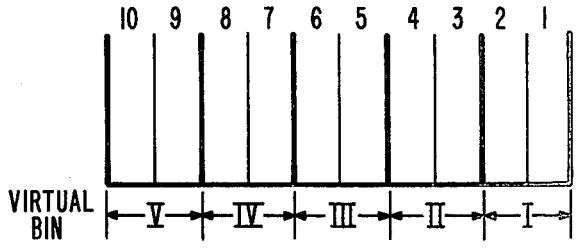

The function of the circuit shown in FIG. 7 and described above will be better understood in connection with the discussion of FIG. 8 which shows a table of the different virtual bin configurations dependent upon the copy selection The examples are based on the shown minicollator with ten actual bins.

Upon the operator's selection of two copies to be made from each original, the increment limit circuit 708 switches to an increment limit of five. This means, that the deflector unit 117 is switched after each copy to the next virtual bin which is situated at a distance of five actual bins from the preceeding one. Thus, the first copy will be fed into actual bin 1 which, at the same time, is the first actual bin in virtual bin I. After this, deflector unit 117 is stepped forward by increment solenoid 401 five times and reaches actual bin 6 which forms the first bin of virtual bin II. The second copy is thus fed into actual bin 6. Now, the virtual bin counter 707 shows that the second and last virtual bin has been reached. Thus, deflector unit 117 has to be returned to its original position which is done by actuating return solenoid 607 via return solenoid control circuit 704. The flow diagrams in FIGS. 9C and 9E show the functional interrelationships. As deflector unit 117 reaches its initial position under actual bin number 1, return switch 215 is actuated. The next copy again actuates sheet switch 502, thus advancing sheet counter 705 to count 2. After that, deflector unit 117 steps again under actual bin 6, wherein the next copy is fed.

Assuming that the number of originals is larger than the capacity of each actual bin, in the present case, the number of originals has to be larger than twenty. As twenty sheets are fed into actual bin 1, full bin counter 706 is advanced. This indicates, that the first actual bin has to be skipped. Thus, deflector unit 117 advances automatically under actual bin 2 which forms the second bin in virtual bin I. After feeding a copy sheet into bin 2, deflector unit 117 is again advanced over five steps thus feeding the following sheet, which is the second copy of original number 21, into actual bin 7 which forms the second bin of virtual bin II. Upon filling of actual bins 2 and 7, this procedure is repeated, thus filling actual bins number 3 and 8.

If the operator selects with the copy selector 702 that he wants 3 copies of each original, the increment limit circuit 708 controls incrementing and return of deflector unit 117 in the following way: Upon feeding of the first copy into actual bin 1 forming the first bin of virtual bin I, increment solenoid control 703 advances deflector unit 117 to actual bin 4, thus skipping actual bins 2 and 3. Bin 4 forms the first bin of virtual bin II. As soon as the next copy is fed into actual bin 4, which is detected by sheet switch 502, deflector unit 117 is incremented to actual bin 7, forming the first bin of virtual bin III. Upon feeding the third copy into actual bin 7, deflector unit 117 is returned into its home position. Actual bin 10 is not used in copy select mode code "3". As soon as full bin counter 706 indicates that the first actual bin of each virtual bin is filled, deflector unit 117 is moved under actual bins 2, 5 and 8 respectively.

If the copy selector 702 is set to "4" or "5", the collator control logic forms five virtual bins. Virtual bin I consists of actual bins 1 and 2, virtual bin II of actual bins 3 and 4, etc. Upon selection of four copies to be made of each original, virtual bin V, consisting of actual bins 9 and 10 is not used and deflector unit 117 returned into its initial position upon feeding into virtual bin IV. The whole procedure is carried out as described above.

The remaining FIGS. 9A to 9E show in different detail flow charts of the functions performed by the logic circuits of the collator. The numbers found beside the blocks in the flow charts relate to the parts as shown in FIGS. 1 to 7.

Figure 9A:
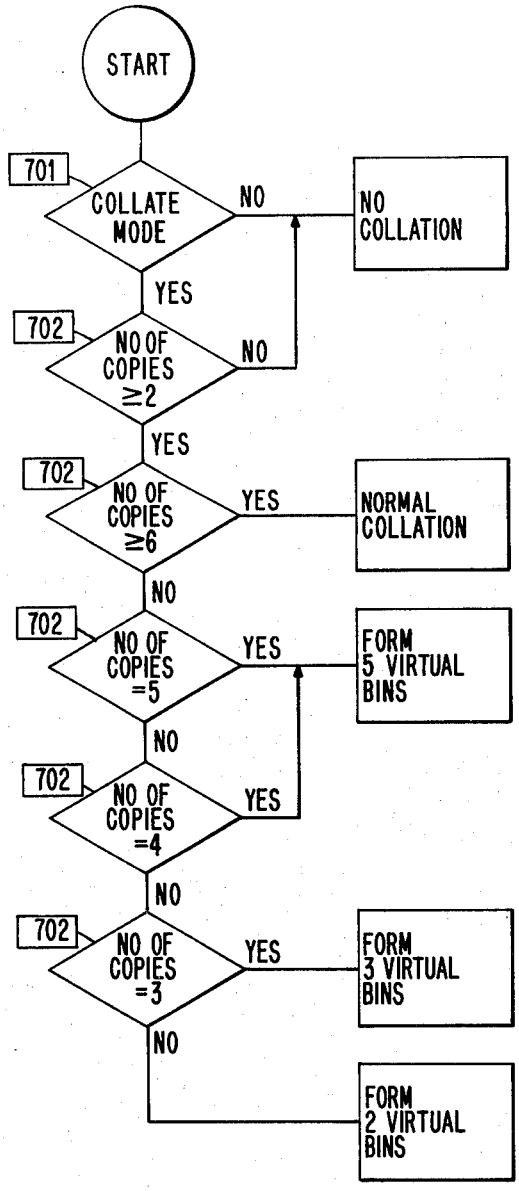
Figure 9B:
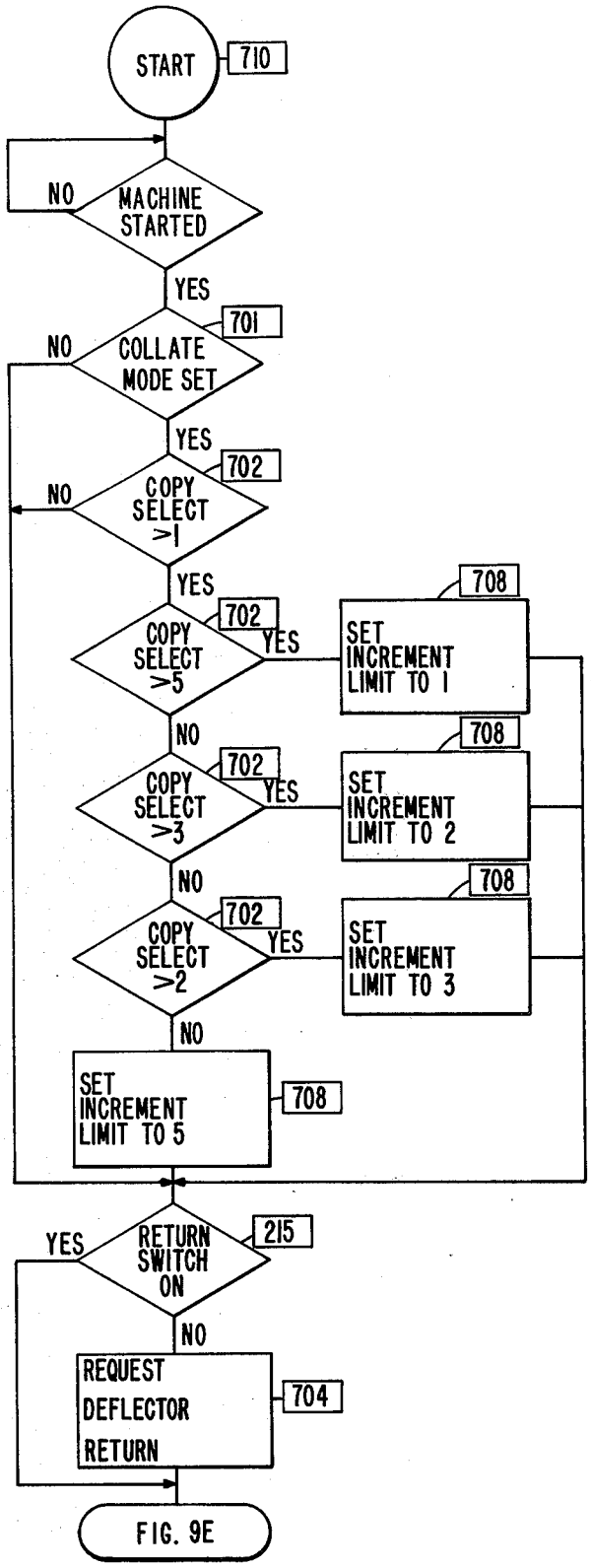
Figure 9C:
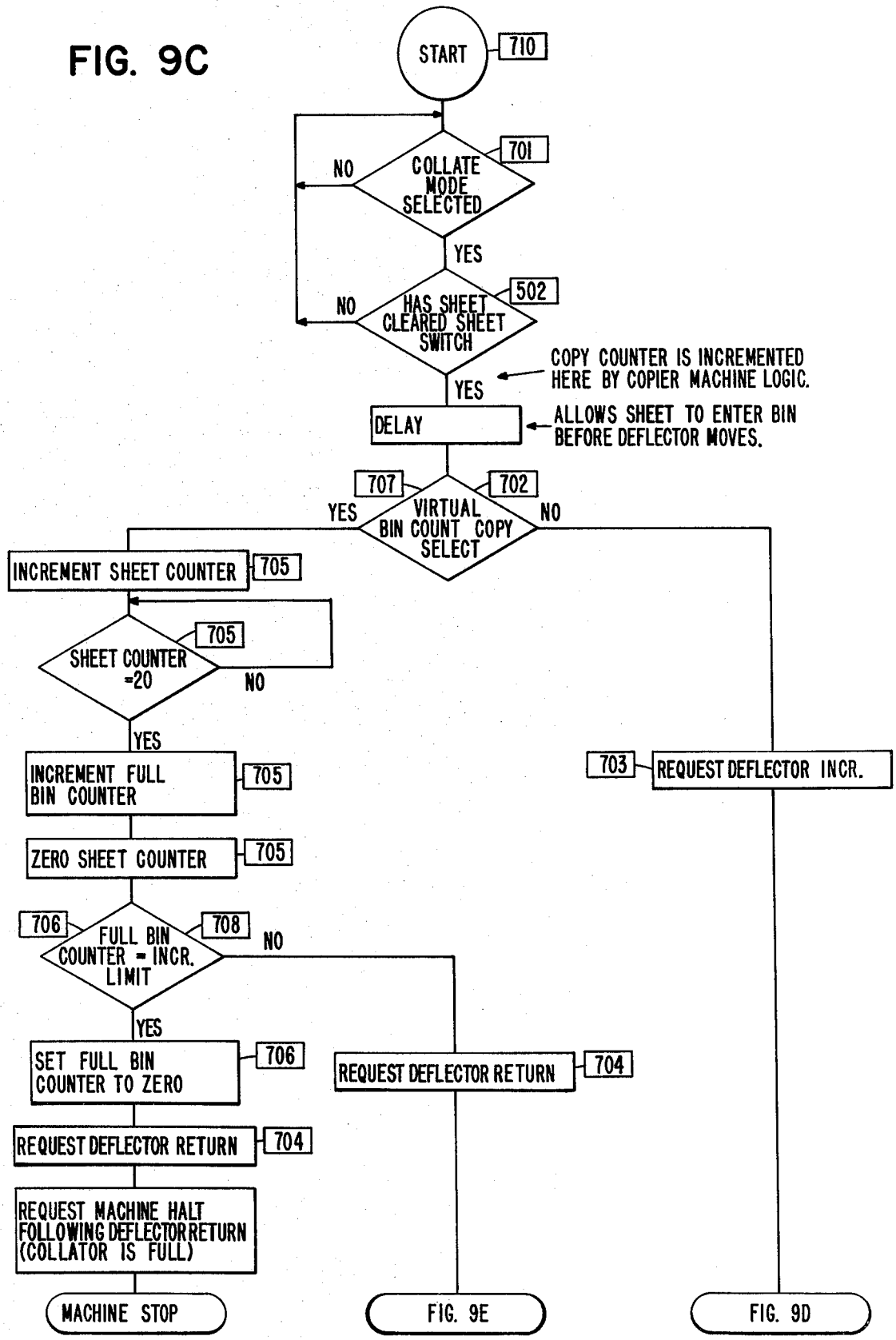

FIG. 9A is a very general description of the function as discussed already above. After the start of the copier, two conditions have to be fulfilled to initiate the "virtual bin collation". First, the operator has to select "collate mode" through collate mode selector 701. Additionally, the number of copies selected by copy selector 702 has to be equal or larger than two, otherwise collation is not required. Furthermore, there is an upper limit defining the actual function of the collator. In the present example, if the number of copies equals or is larger than six, virtual collation is obviously impossible, thus normal collation will be executed. If the copy selector 702 shows either "5" or "4", five virtual bins, each existing of two actual bins, will be formed. If the copy selector 702 shows "3", three virtual bins, each consisting of three actual bins, will be formed. Actual bin 10 is not used in this mode. If the number of copies selected is neither "5", "4", or "3", nor equal to or larger than "6", two virtual bins are formed by the logic, each consisting of two actual bins.

FIGS. 9B and 9C show in some more detail the functions performed by collator logic 710. Whereas FIG. 9B is related to the starting procedure, in particular, the setting of the increment limit circuit 708, FIG. 9C shows the general function of the control logic during collation.

FIG. 9D relates to the increment control function of increment solenoid control circuit 703 as shown in FIG. 7. FIG. 9E describes the return control function of the return control circuit 704 in a flow chart presentation.

All FIGS. 9A to 9E show flow charts which are self-explanatory and well understood by somebody skilled in the art in their relationship to the described embodiment of the invention. However, it should be understood that these flowcharts are only an example showing one possible functional implemenatation of the invention. The implementation itself can be executed by programming a computer as well as by wiring hardware.

Although the invention has been described and explained with respect to a particular embodiment and in the context of a copier and moving deflector collator environment by way of example, it will be understood that various changes, modifications and applications other than those specifically mentioned herein can be carried out by those skilled in the art without departing from spirit, thrust and scope of the invention.

What is claimed is:

1. Method for automatically controlling the operation of a sheet collator with K actual bins when collating a number M of multi-sheet sets, if $M<K$, wherein all first sheets of each of said M sets are successively introduced into said collator, including the steps of:

determining a number H of virtual bins, such that $H>M$, at least one of said H virtual bins consisting of at least two adjacent actual bins, defining the actual bins constituting each virtual bin prior to the feeding of said first sheet of the second of said M sets into one of said bins, identifying the first actual bin not filled to its capacity of each of the H virtual bins, and controlling sheet deflection for sequential sheet feeding into said identified first actual bins.

2. Method as defined in claim 1, including the steps of:

detecting sheet delivery into said actual bins, and controlling sheet deflection in response to said detected sheet delivery for causing sheet feeding into an actual bin of the next virtual bin.

3. Method as defined in claim 2, including the steps of:

determining when an actual bin is full, and controlling sheet deflection in response to said full bin determination for causing sheet delivery to the next actual bin of each virtual bin.

4. Method as defined in claim 3, including the steps of:

determining when a virtual bin is full, and producing a signal indicating said full virtual bin status.

5. Method as defined in claim 1, including the steps of:

sensing the number M of sets selected for collation, and comparing said number M of sets with said number K of actual bins.

6. Method for automatically controlling the operation of a sheet collator with K actual bins when collating a number M of multi-sheet sets, if $M \leqq K/2$, wherein all first sheets of each of said M sets are successively introduced into said collator, including the steps of:

defining M virtual bins, each virtual bin consisting of K/M adjacent actual bins, prior to the feeding of said first sheet of the second of said M sets into one of said bins, identifying the first actual bin not filled to its capacity of each of the M virtual bins, and controlling sheet deflection for sequential sheet feeding into said identified first actual bins.

7. Method for automatically controlling the operation of a sheet collator with K actual bins when collating a number M of multi-sheet sets, if $M \leqq K/2$, wherein all first sheets of each of said M sets are successively introduced into said collator, including the steps of:

prior to the feeding of said first sheet of the second of said M sets into one of said bins, determining M virtual bins, each virtual bin comprising N adjacent actual bins, such that $K = MN + R$, wherein R is the number of actual bins in excess of those needed for collating M sets, identifying the first actual bin not filled to its capacity of each of the M virtual bins, and controlling sheet deflection for sequential sheet feeding into said identified first actual bins.

8. Apparatus for automatically collating a number M of multi-sheet sets, wherein all first sheets of each of said M sets are successively introduced into said apparatus, comprising:

a number K of actual sheet receiving bins, sheet deflector means operable for sheet feeding into said actual bins, means for determining a number H of virtual bins in response to said number M, such that $H \geqq M$, at least one of said H virtual bins consisting of at least two adjacent actual bins, means for defining the actual bins constituting a virtual bin prior to the feeding of said first sheet of the second of said M sets into one of said bins, means connected with said defining means for identifying the first actual bin not filled to its capacity of each of the H virtual bins, and means for controlling said sheet deflector means for sequential sheet feeding into said identified first actual bins.

9. Collator as defined in claim 8, including:

means for detecting sheet delivery into said actual bins, said detecting means being operatively connected with said controlling means for causing sheet feeding into an actual bin of the next virtual bin subsequent to said detected sheet delivery.

10. Collator as defined in claim 9, including:

means for indicating when an actual bin is full, said indicating means being operatively connected with said controlling means for causing sheet feeding into the next actual bin of each virtual bin.

11. Collator as defined in claim 10, including:

means for recognizing when a virtual bin is full, and means operatively connected with said recognizing means for producing a signal indicating said full virtual bin status.

12. Apparatus as defined in claim 8, further comprising:

means for sensing said number M of sets selected for collation, said determining means being connected with said sensing means and determining said number H of virtual bins in response to said sensed number M of sets.

* * * * *

UNITED STATES PATENT AND TRADEMARK OFFICE

CERTIFICATE OF CORRECTION

PATENT NO. : 4,134,581

DATED : January 16, 1979

INVENTOR(S) : Frederick W. Johnson; Carl A. Queener; James C. Rogers

It is certified that error appears in the above-identified patent and that said Letters Patent are hereby corrected as shown below:

In Claim 1, line 7, delete"H>M" and insert --H≥M--.

Signed and Sealed this

*Eleventh* Day of *September 1979*

[SEAL]

*Attest:*

*Attesting Officer*

LUTRELLE F. PARKER

*Acting Commissioner of Patents and Trademarks*